United States Patent [19]

Wigby et al.

[11] 4,272,879

[45] Jun. 16, 1981

[54] METHODS AND APPARATUS FOR MAKING ELECTRICAL CONNECTORS

[76] Inventors: Jon Wigby, 183 Sugar St., Newtown, Conn. 06470; Ralph L. Piatt, R.F.D. #2 Salem Rd., Pound Ridge, N.Y. 10576; James D. Anderson, 2 Timothy Rd., Norwalk, Conn. 06850

[21] Appl. No.: 8,999

[22] Filed: Feb. 5, 1979

[51] Int. Cl.[3] ..... H01R 43/04

[52] U.S. Cl. ..... 29/566.2; 29/33 M; 29/747; 29/749; 29/863; 29/866; 29/884

[58] Field of Search ..... 29/33 M, 564.1, 564.6, 29/566.2, 749, 751, 753, 747, 863, 865, 866, 867, 884

[56] References Cited

U.S. PATENT DOCUMENTS 4,040,167 8/1977 Jepson et al. ..... 29/564.4

4,074,424 2/1978 Deshich et al. ..... 29/754

*Primary Examiner*—Z. R. Bilinsky

[57] ABSTRACT

This invention relates to methods and apparatus for making electrical connectors and, in one embodiment suitable for use with a multiplicity of parallel planar arrayed, spaced-apart insulated conductors, comprises means for and the steps of retainably positioning the conductor array above the crimp retainer portions of interconnected connector members, inserting the conductors into the connectors, positionally affixing the conductors to the connectors as by crimp means encircling the cable insulation and crimp means enveloping the exposed cable conductors, shearing the strips which interconnect the connector members to each other, and inserting the cables and their associated connectors into an associated connector block.

3 Claims, 9 Drawing Figures

Fig. 6.
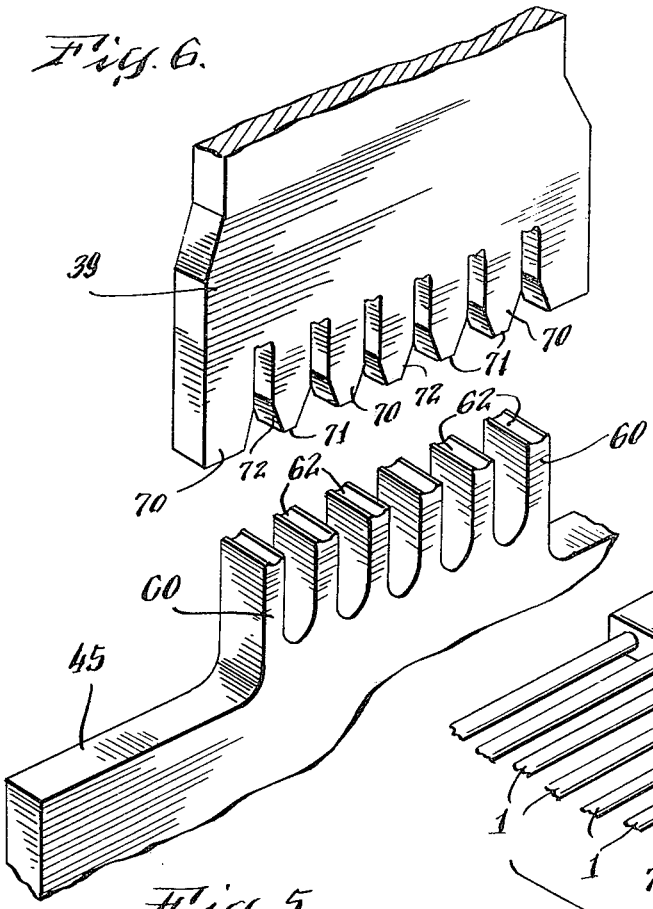
Fig. 5.
Fig. 7.
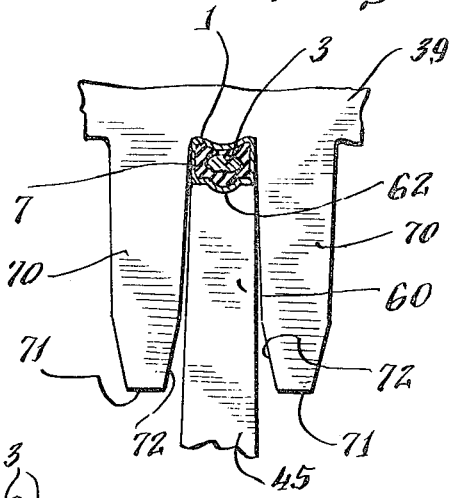
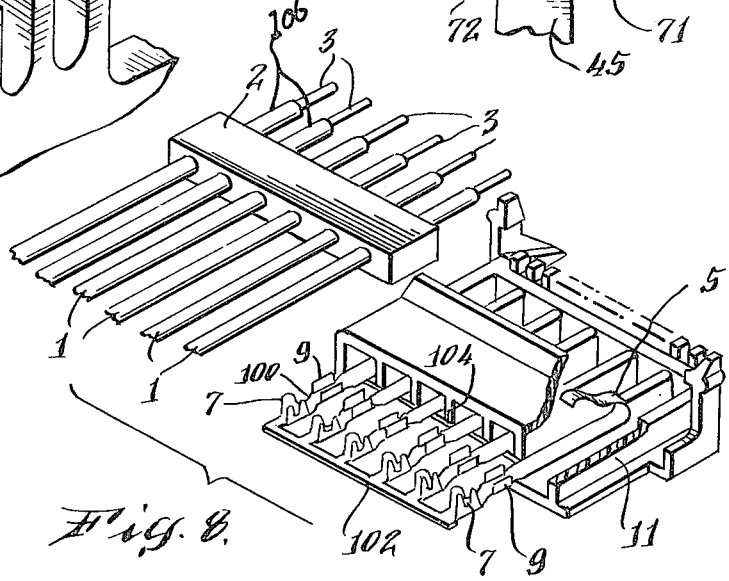
Fig. 8.
Fig. 9.
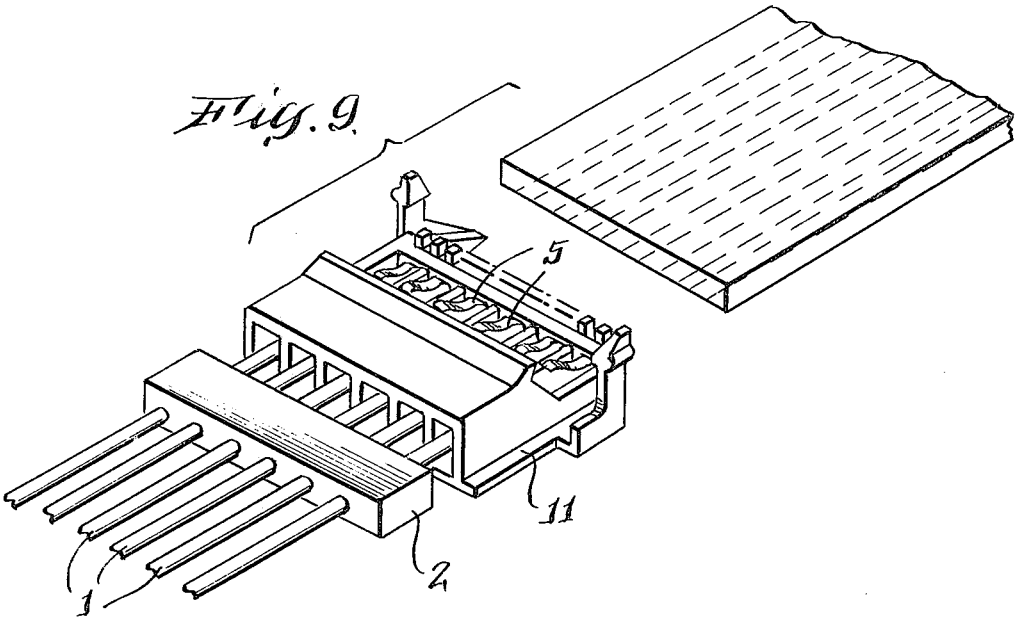

METHODS AND APPARATUS FOR MAKING ELECTRICAL CONNECTORS

BACKGROUND OF INVENTION

In the field of electrical connectors, frequently it is desired to interconnect a group of insulated conductor wires or cables with a common connector receptacle. In the interests of reducing labor factors and otherwise effecting economics, it is desired to perform the steps of making such connectors and interconnecting them with their associated cables as fully automatically as possible. In the past it has been a practice to affix individual connector members to the ends of insulated wires by means of crimping tabs applied to the outside of the insulation of each such wire and crimping tabs bearing upon the conductor portion. The multiplicity of such assemblages can then be inserted into a connector block having a multiplicity of receptacle apertures therefor. The labor, time and cost for effecting connection by this means have proved to be so high that attempts have been made to perfect means for more fully automating the production of such "gang" connectors and the harnesses with which they usually are associated.

Accordingly, it is an object of the present invention to provide means for affixing connectors to a multiplicity of insulated conductors.

Another object of this invention is to achieve such results using methods and apparatus which are susceptible to subtantial automation.

Another object of this invention is to provide apparatus and methods for achieving the foregoing objectives which will be inexpensive and reliable.

SUMMARY OF INVENTION

Desired objectives may be achieved through practice of the present invention which in one embodiment comprises gripper means for gripping and positionally locating a parallel array of insulated conductors in desired proximity to an array of crimp type connectors which may be inserted into on associated connector block, means for shearing the strips interconnecting the connectors in the array, and means for crimping the connectors onto the ends of the insulated conductors, and means for thrusting the assemblage of connectors and their associated insulated conductors into the associated connector block.

DESCRIPTION OF DRAWINGS

This invention may be understood from the description which follows and from the attached drawings in which:

FIG. 5 is a perspective drawing of a wire crimp anvil, useful in the embodiment of this invention shown in FIGS. 1 through 4, FIG. 6 is a perspective drawing of an upper insulation crimp blade useful in the embodiment of this invention shown in FIGS. 1 through 4, FIG. 7 depicts an insulated conductor to which a connector has been crimped using the components shown in FIGS. 5 and 6, FIG.8 depicts the constituent components which may be used to produce connector assemblages utilizing the embodiment of this invention shown in FIGS. 1 through 4, FIG. 9 depicts a completed connector assembly made in accordance with this invention.

DESCRIPTION OF PREFERRED EMBODIMENTS

Figure 1:
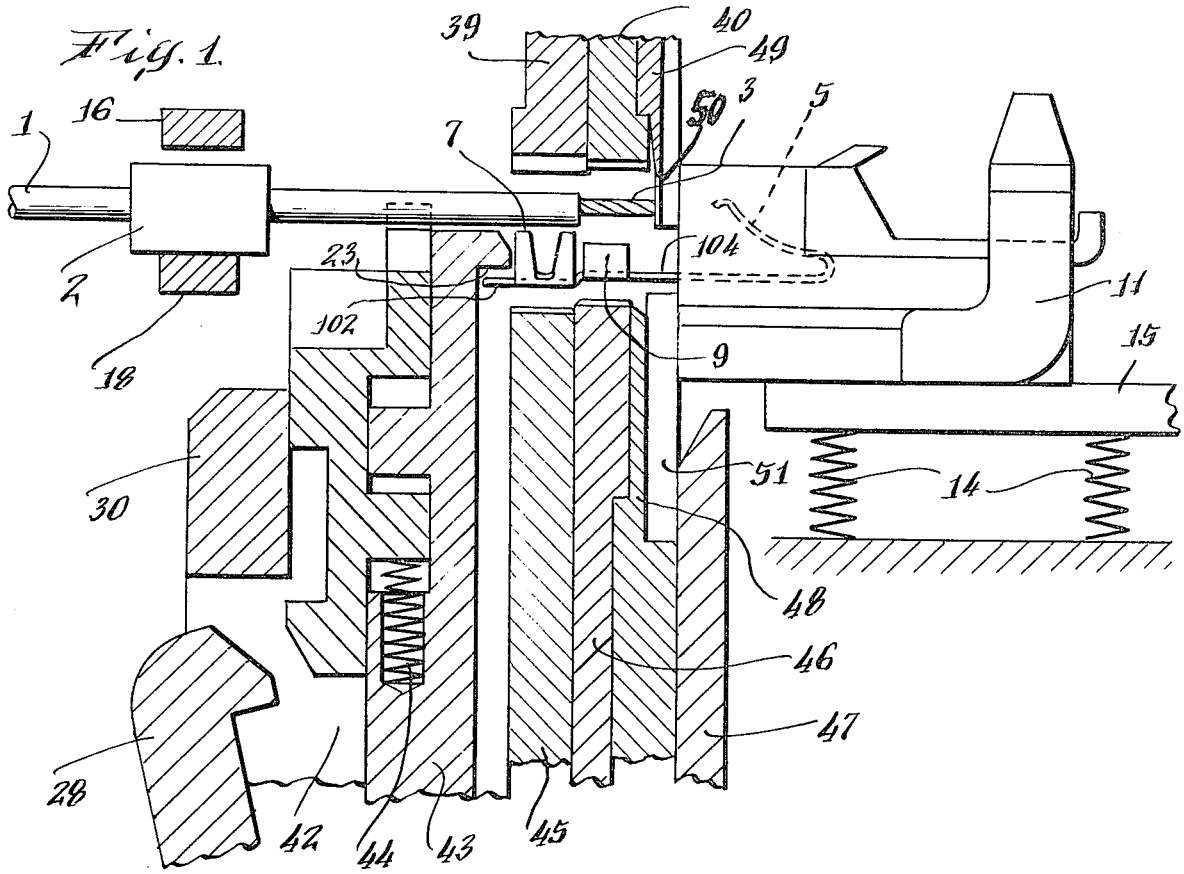
FIG. 1 is a cross-sectional drawing of an embodiment of this invention in the first-stage of operation.

Referring first to FIGS. 1 through 4, there is depicted an embodiment of this invention comprising the following components: Grippers 16, 18; upper insulation crimp blade 39; upper wire crimp blade 40; punch center shear 49; wire stop 50; die center shear 47; chip retainer center shear 48; a chip chute 51; wire crimp anvil 46; insulation crimp anvil 45; front shear 43 and an associated return spring 44; wire guide 42; front shear latch 28; and wire guide 30. The structural details of the insulation crimp anvil 45 are shown in greater detail in FIG. 5 as having raised "land" portion 60, the top of each of which has an arcuate groove 62 upon which may be positioned the underside of the connector strip which is to be fabricated in the device as herein described. Thus, this particular anvil 45, having 6 lands 60, is adapted for work on up to 6 conductors at a time, although it will be clear from the description which follows that another number may also be fabricated utilizing the same apparatus. FIG. 6 shows structural details of upper insulation crimp blade 39. It will be seen that by virtue of the crimp teeth 70, the ends 71 of which have bevel 72 to affectuate crimping of insulation crimp prongs 7 as hereinafter described, this particular embodiment is also adapted to accommodate up to 6 conductors in any connector at a given time, but obviously may be used to accommodate another number as well.

FIG. 7 is a cross-sectional representation of connector insulation crimp tabs 7 which have been crimped about the insulation of an insulated conductor 1 through cooperative inter-engagement of the teeth 70 of upper insulation crimp blade 39 with the land 60 of insulation crimp anvil 45, to effect an interconnection of the conductor with its associated connector as hereinafter described.

FIG. 8 illustrates the components of the type on which apparatus in accordance with this invention is designed to be used. As illustrated, a receptacle block 11 has partially inserted into it a connector clip 100 having a contact prong end 5 at one end and, at the opposite or shank end, insulation crimp tabs 7 and conductor crimp tabs 9. The contact clip 100 is made by stamping it out of conductive sheet metal and, to facilitate handling, is produced first in the form of a strip or ribbon of individual connectors joined together by front joining strip 102 and a rear joing strip 104. The connector group is only partially inserted into the connector block 11 in order to expose the insulating crimp tabs 7 and the conductor crimp tabs 9 of each constituent connector so that they respectively may receive the outer insulation jacket 106 and the conductor 3 of a preformed parallel array of insulated conductors. Such conductors are held in parallel-planar spaced-apart relationship with respect to each other by means of gripper blocks 2 in the form of solid plastic members molded about the outside of the insulated conductors in the vicinity of one end. As will be apparent from FIG. 8, when such a cable array is located so that the cable ends are so positioned that the insulation wall 106 of each may be placed in a set of insulation crimp tabs 7, and so that the conductors 3 of each may be placed within a set of conductor tabs 9, the tabs 7, 9 may be crimped to affect contact retention of the outside of each cable and its conductor respectively. The joining strips 102, 104 may then be severed so as to render the individual conductors and their associated connector members electrically and structurally independent of each other, and the connector, and each cable connected thereto, may be thrust into the final retained position within its associated connector block, as shown in FIG. 9. It is these tasks that the present invention is designed to achieve.

Referring again to FIGS. 1 through 4, FIG. 1 depicts an embodiment of the present invention at a first-stage of operation. As shown, an assembly of cables 1 has been positioned between the grippers 16, 18, preparatory to their being closed down on the gripper block 2 to hold the cable in desired position with respect to the apparatus, with the end of each conductor 3 abutting a wire stop 50. The individual cables 1 aligned by means of grooves 6 in the top of the wire guide 42 which, by virtue of the front shear latch 28 being in the unlatched position, has been moved upward in response to pressure exerted thereon by the return spring 44. The effect of this is to raise the floors of the wire guide 42 grooves 6, above the top of the front shear 43, to align the conductors with respect to an array of connectors while permitting the front joining strap 102 to be positioned beneath the shear surface 23 of the front shear 43 for cutting as hereinafter described. Prior to the cable assembly being so positioned, a pre-assembled connector group and the associated connector block 11 into which the connector group has been partially inserted, of the type shown in the lower portion of FIG. 8, was positioned in a "nest" or carrier 15, by means of which the block 11 may be moved laterally, (i.e. toward the viewer in FIGS. 1 through 4), to a position where the shank ends of the connectors are aligned with the grooves in the top of the wire guide 42, thereby assuring that the ends of cables residing in the wire guide grooves, when the gripper block 2 is positioned between the gripper 16, 18, will be so located that the insulation wall of each cable is juxtaposed to the insulation tabs 7 of a connector and the conductor of each cable is juxtaposed to the conductor crimp tabs 9 of a connector.

Figure 2:
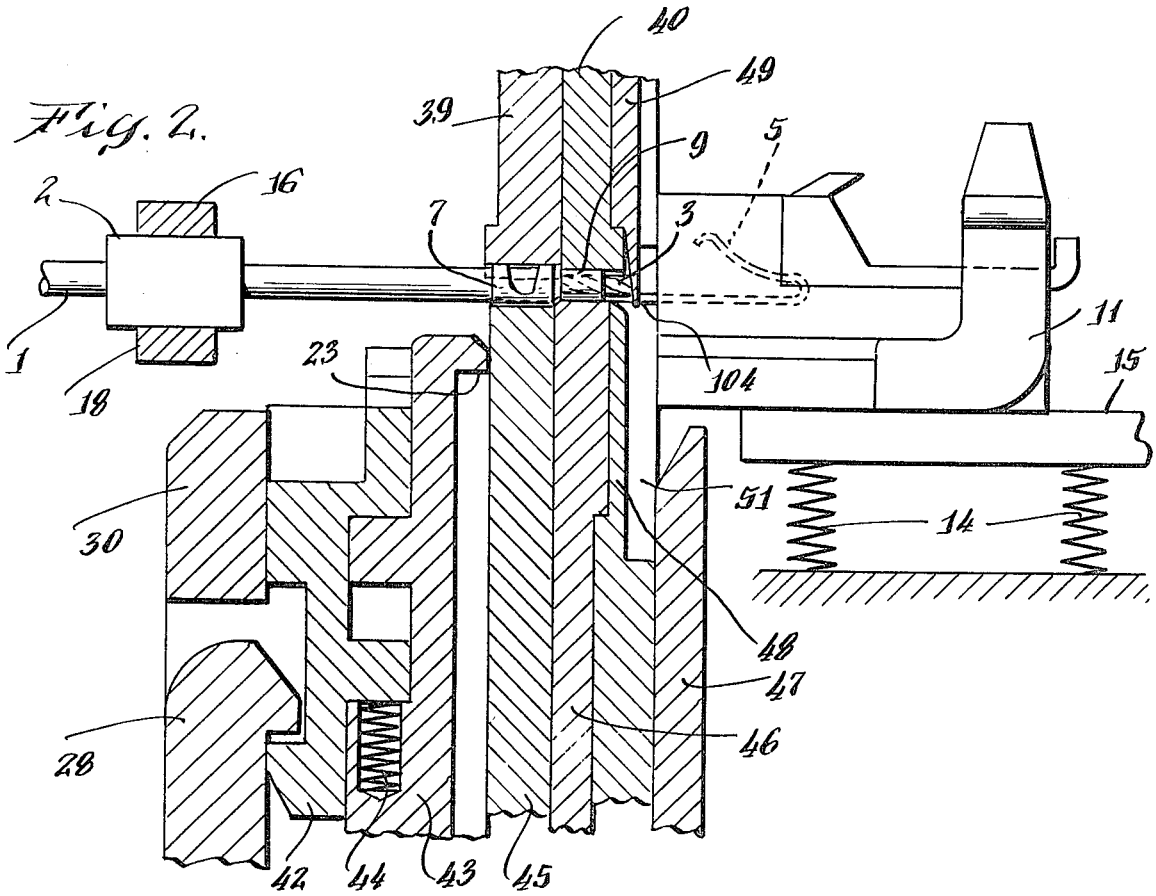
FIG. 2 is a cross-sectional drawing of the embodiment of this invention shown in FIG. 1 in a second-stage of operation.

The next stage of operation is shown in FIG. 2 where the front shear latch 28 is moved forward so as to be able to affect a latch with the associated portion of the wire guide 42, the wire guide 42 has been moved downward by a connecting rod (not shown) against the bias effect of the spring 44, the grippers 16, 18 have moved toward each other so as to grip the block 2, the front shear 43 has moved downward with the result that the portion of the front joining strip 102 between each connector member is sheared off by the front shear 43; the insulation crimp blade 39 has moved downward against the blocking effect of the insulation crimp anvil 45 causing the insulation crimp tabs 7 to be crimped tightly about the outside of the insulation wall of the cable associated with it, the wire crimp blade 40 has moved downward against the blocking effect of the wire crimp anvil 46 causing the conductor crimp tabs 9 to be crimped tightly about the conductor 3; and the punch center shear 49 has moved downward past the conductor stops 50 against the chip retainer center shear 48. This last portion of the operation results in the portions of the rear joining strip 102 between the connector members being sheared away, the resulting chips falling out of and away from the region via the chip chute 51, thereby finally isolating the individual connector members electrically and structurally from each other.

Figure 3:
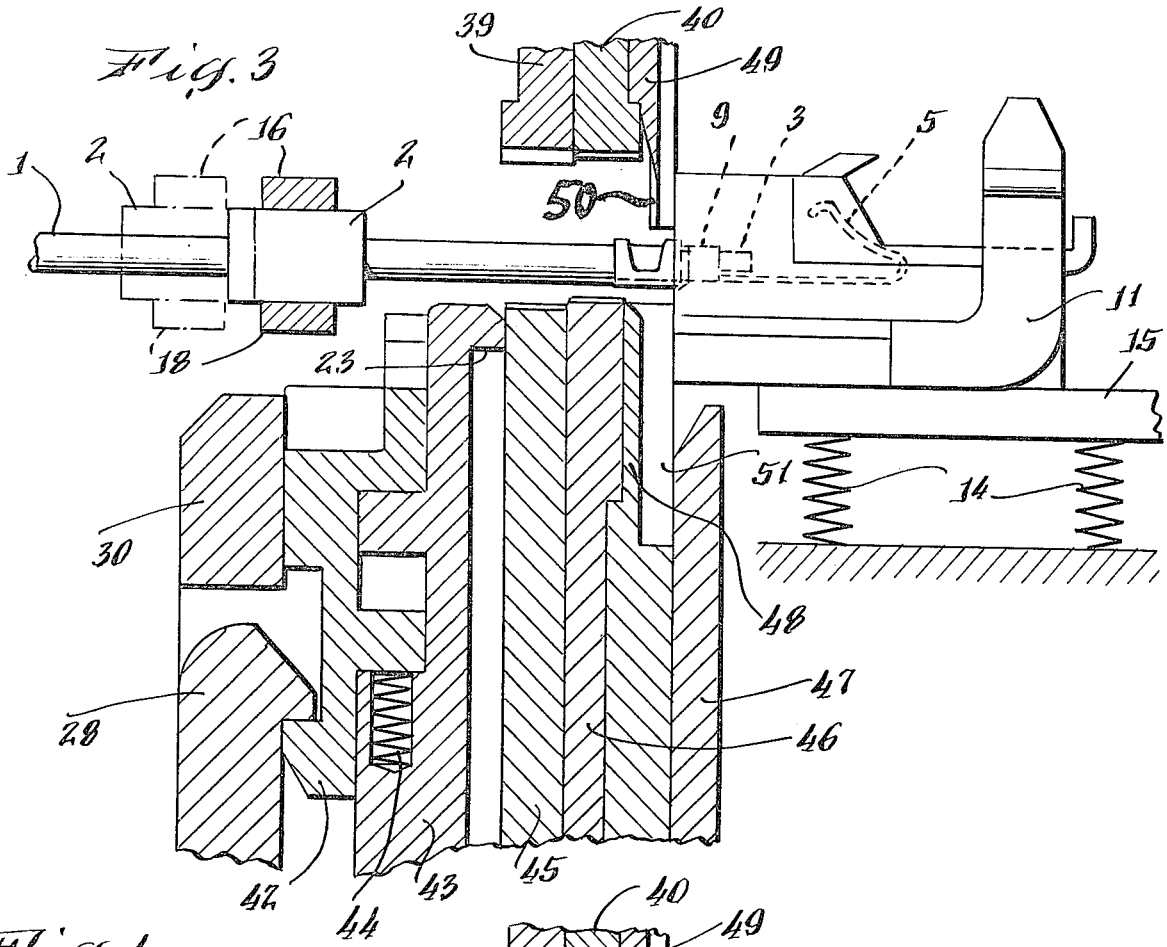
FIG. 3 is a cross-sectional drawing of the embodiment of this invention shown in FIGS. 1 and 2 in a third-stage of operation.

FIG. 3 illustrates the next step in the sequence. The wire guide 42 has moved upward, but only to a limited extent compared to that shown in FIG. 1 due to the latching effect of the latch 28 acting in concert with the corresponding latch on the wire guide 42. The insulation crimp blade 39, the upper wire crimp blade 40, and the punch center shear 49, have all moved upward clear of the associated cable connectors, so that the cables and connectors associated therewith are held only by the grippers 16, 18 and the partial insertion of the connectors into the connector block. Thus, while restricted from vertical movement, the connector members in the cable end are free to move laterally. The grippers 16, 18 have moved laterally to the right, causing each conductor to push the connector associated with it into the associated block 11, the latter being positionally stable by the nest 15 in which it sits. As shown in FIG. 3, this insertion operation is shown as being in only a partially completed stage.

Figure 4:
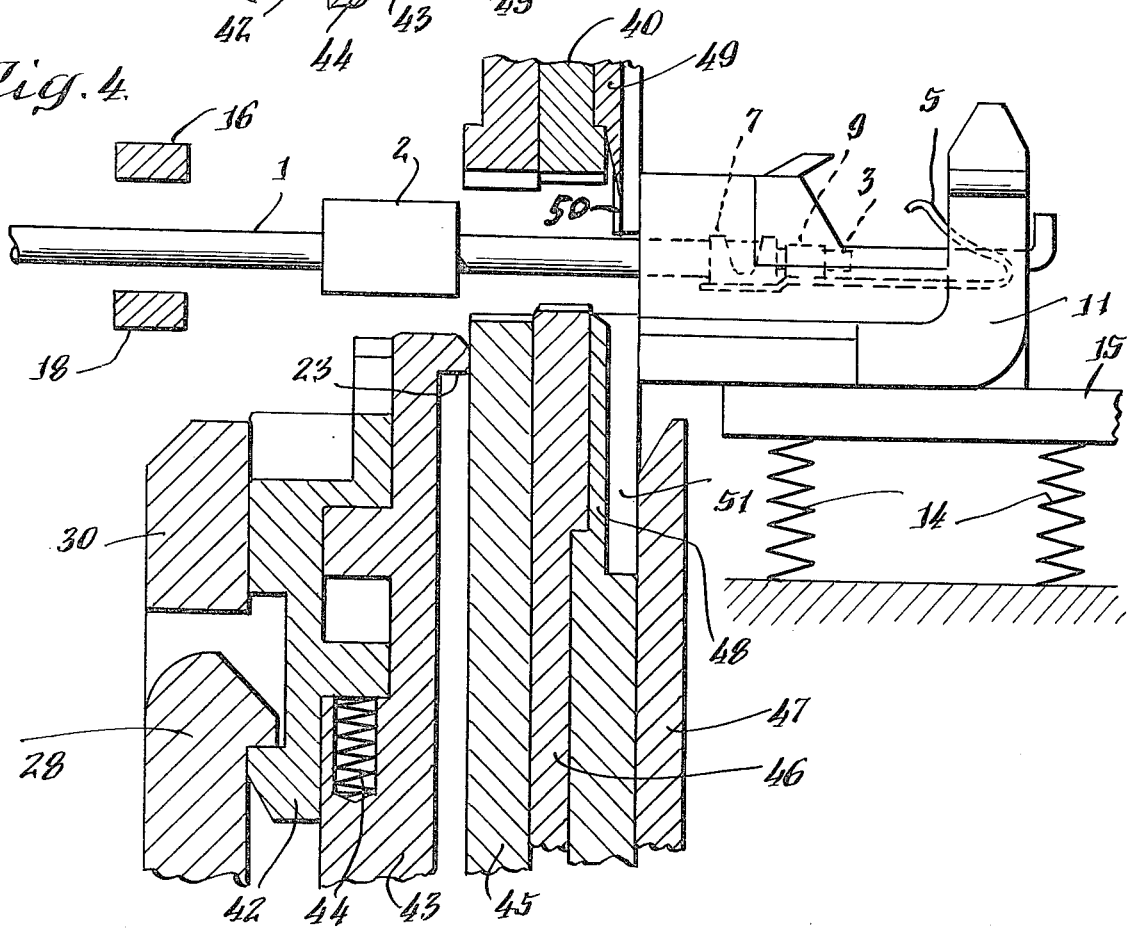
FIG. 4 is a drawing of a cross-section of the embodiment of this invention shown in FIGS. 1 through 3 in a fourth-stage of operation.

In FIG. 4, the cables and their associated connectors have been inserted into their final position within the connector block 11, and the grippers 16, 18 have opened up and moved back outward, so that the assemblage may be removed from the apparatus. Upon insertion of another connector-block sub-assembly into a nest and a cable assembly between the grippers, and the latch 28 allowing the guide 42 to move upwards, the initial step previously described and shown in FIG. 1 may be reinitiated.

In the embodiment of this invention described above, it will be apparent to those ordinarily skilled in the cognizant arts that actuation of the various components to cause them to move relative to each other as desired may be carried out by means of connecting rods interconnected with cams or other known per se programmed prime movers, solenoids, and/or other known per se means for imparting such motion.

It is to be understood further that the embodiments of the present invention herein discussed and illustrated are by way of illustration and not of limitation, and that this invention may be practiced in a wide variety of embodiments without departing from the spirit or scope of this invention.

We claim:

1. A machine for installing electrical termination connectors simultaneously on the ends of a plurality of wires which have previously been coupled together and arrayed in substantially planar, parallel, spaced-apart relationship with bared conductor ends thereof exposed for presentation to said machine, comprising:

a base;

gripper means movable relative to said base in a direction transverse to the plane of a planar array of wires for gripping such an array in substantially fixed position relative to said base, at a point axially spaced from the ends of wires;

wire guide means having a plurality of open grooves for receiving individual wires therein, positioned between said gripper means and the ends of wires held therein, said guide means being movable in a direction transverse to the axes of wires held in said gripper means between a first non-engaging position and a second wire-engaging position;

connector support means for positioning a plurality of electrical contacts in position to receive the ends of individual wires held by said gripper means;

movable contact crimping means positioned to engage and deform a plurality of contact elements supported in said connector support means onto the ends of a plurality of wires held by said gripper means;

means for moving said gripper means in the direction of the axes of wires gripped therein to advance such wires axially into a connector supported in said connector support means together with contacts installed on such wires, when said guide means has moved from said wire-engaging position to said non-engaging position.

2. A machine in accordance with claim 1 further including shear means movable with said crimping means in a direction parallel to the motion of said crimping means to sever a connecting link between adjacent contacts supported in said connector support means.

3. A machine in accordance with either claim 2 or 3, comprising releasable latch means for retaining said wire guide means in said non-engaging position; and spring means for biasing said wire guide means into said wire engaging position when said latch means has been released.

* * * * *